United States Patent [19]

Tranquillitsky

[11] 4,005,644

[45] Feb. 1, 1977

[54] METHOD FOR MAKING A CAN CARRIER

[76] Inventor: George V. Tranquillitsky, 3161 Lynde St., Oakland, Calif. 94601

[22] Filed: Aug. 13, 1975

[21] Appl. No.: 604,492

Related U.S. Application Data

[62] Division of Ser. No. 489,132, July 17, 1974, abandoned.

[52] U.S. Cl. ..... 93/37 SP; 93/49 M

[51] Int. Cl.[2] ..... B31B 1/26

[58] Field of Search ..... 229/16 R, 16 A; 206/141, 434; 93/37 R, 37 EC, 37 SP, 49 M, 49 R, 52, 53 M, 53 R, 48, 36 M; 53/186

[56] References Cited

UNITED STATES PATENTS

| | | | |
|---|---|---|---|
| 2,656,960 | 10/1953 | Carruth | 206/141 |
| 2,722,365 | 11/1955 | Phipps | 206/434 |
| 2,779,499 | 1/1957 | Chidsey, Jr. | 206/141 |
| 3,140,036 | 7/1964 | Spery | 206/141 UX |
| 3,411,663 | 11/1968 | Moore et al. | 83/37 SP X |

*Primary Examiner*—James F. Coan
*Attorney, Agent, or Firm*—Phillips, Moore, Weissenberger, Lempio & Strabala

[57] ABSTRACT

A one-piece paperboard blank is formed into a can carrier by sequentially folding and gluing the panels and flaps of the blank together while moving it along a linear path. The completed "six-pack" carrier comprises top and bottom panels connected together by a pair of end panels and a pair of first and second partitions secured between the top and bottom panels and disposed intermediate the end panels to define three separate cells. A flap secures the bottom panel to each of the partitions whereas a bridging panel secures the partitions to the top panel.

2 Claims, 5 Drawing Figures

A
B
C
P
10
11
12
13
14
15
16
17
18
19
20
21
22
23
24
25
26
27
28
29
30
31
32
33
34
35
36
37
38
39
40
42
43

METHOD FOR MAKING A CAN CARRIER

This is a division of Ser. No. 489,132, filed July 17, 1974, and now abandoned.

BACKGROUND OF THE INVENTION

The spiralling costs of paperboard and like packaging materials has dictated the need for can carriers which can be constructed from a minimum amount of material. Whereas certain prior art can carrier constructions attempt to achieve such material savings, they oftentimes impair the structural integrity of the carrier and require complicated apparatus and methods for making the same. Wrap-around carriers of this type are disclosed in U.S. Pat. Nos. 2,656,960; 2,722,365; 2,790,590; 2,812,105; 2,834,508; 2,839,235; 2,980,249; 3,161,344; and 3,283,990.

SUMMARY OF THE INVENTION

An object of this invention is to provide an economical carrier for cans and like articles which exhibits a high degree of structural integrity and a method for making the same expeditiously. The carrier comprises top and bottom panels connected together by a pair of end panels and a pair of upstanding partitions disposed in parallel relationship with respect to the end panels to define three article-carrying cells in the carrier. A flap secures the bottom panel to each of the partitions and a bridging panel, interconnecting the upper ends of the partitions, is secured to an underside of the top panel. The carrier is formed by moving the carrier's one-piece blank along a linear path and by sequentially folding and securing such panels together during such movement.

BRIEF DESCRIPTION OF THE DRAWINGS

Other objects of this invention will become apparent from the following description and accompanying drawings

DETAILED DESCRIPTION

Figures 1, 2, 3, 4, 5:
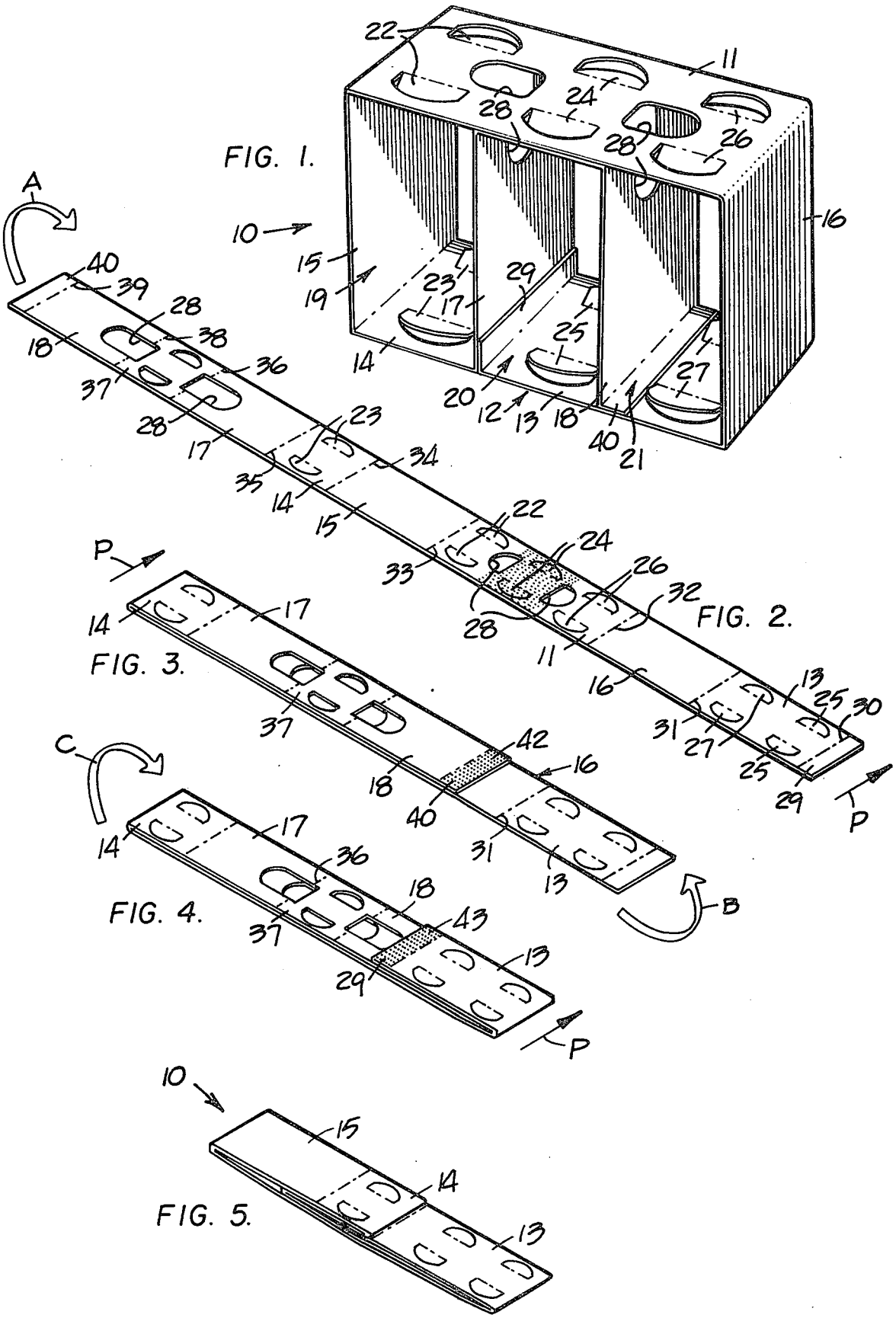
FIG. 1 is a perspective view illustrating a three cell wrap-around can carrier embodiment of this invention.
FIG. 2 is a bottom plan, isometric view of a one-piece blank utilized to make the FIG. 1 carrier.
FIGS. 3–5 sequentially illustrate folding and gluing steps for making the FIG. 1 erected carrier from the FIG. 2 blank.

A three-cell wrap-around can carrier 10, illustrated in FIG. 1, is adapted to be made from the one-piece paperboard blank illustrated in FIG. 2. The carrier comprises a top panel 11, a bottom panel 12, including a pair of co-planar panel portions 13 and 14, and a pair of upstanding end panels 15 and 16 integrally connected to the top and bottom panels. A pair of upstanding first and second partitions 17 and 18 are secured between the top and bottom panels and are disposed in parallel relationship between the end panels to define three cubical cells 19, 20 and 21, each adapted to retain a pair of articles (not shown) therein.

Such articles may comprise cylindrical cans having the chines thereof retained in the carrier by retention means, including pairs of arcuate lock tabs 22, 23, 24, 25, 26 and 27. In particular, each lock tab is adapted to be reverse-folded inwardly of the carrier on a respective top or bottom panel to engage an interior portion of a respective chine in the manner illustrated in U.S. Pat. No. 2,839,235, for example. In addition, the top panel and partitions may have finger holes 28 formed therethrough adapted to facilitate transportation of the carrier.

Referring to FIG. 2, the blank preferably comprises a one-piece paperboard blank suitably cut and scored to adapt it for expeditious formation into the FIG. 1 carrier by suitably modified conventional apparatus. The blank sequentially comprises a first flap 29 articulated to bottom panel portion 13 by a first scoreline 30, second and third scorelines 31 and 32 articulating end panel 16 to bottom panel portion 13 and top panel 11, fourth and fifth scorelines 33 and 34 articulating end panel 15 to the top panel and bottom panel portion 14, sixth and seventh scorelines 35 and 36 articulating first partition 17 to bottom panel portion 14 and a bridging panel 37, and eighth and ninth scorelines 38 and 39 articulating second partition 18 to the bridging panel and to a second flap 40 forming a part of partition 18.

FIGS. 2–5 sequentially illustrate folding and gluing steps employed during a converting operation to form the FIG. 1 carrier, wherein the blank is continuously moved along a linear path P. The first step in such method comprises applying an adhesive pattern 41, such as a standard glue, to the mid-portion of the underside of top panel 11, as shown in FIG. 2. The blank is then folded in the direction of arrow A to break it at scoreline 34 to secure bridging panel 37 to the underside of the top panel at adhesive pattern 41.

A second adhesive pattern 42 is then applied to the free end of flap 40 (FIG. 3) and the blank is folded in the direction of arrow B, at broken scoreline 31, to secure such flap to bottom panel portion 13 (FIG. 4). A third adhesive pattern 43 is then applied to the free end of flap 29 and the multi-layered blank is folded in the direction of arrow C in FIG. 4 to break the four scorelines 33–36 and to secure flap 29 to a lower inner surface portion of partition 17 (FIG. 1) to increase the structural integrity of the carrier thereat, i.e., the adhesive bond between partition 17 and flap 29 will be placed in shear when subjected to the vertical downward load of cans retained in cell 20 of the erected carrier. The completed carrier can be shipped to a packaging facility in its flattened condition and thereat and thereafter filled with a pair of cans in each of cells 19, 20 and 21 to form a six-pack.

I claim:

1. A method for making a side loading carrier on a straight-line gluer from a pre-cut and scored one-piece blank comprising a plurality of parallel scorelines formed thereon to consecutively define a first flap, a first bottom panel portion, a first end panel, a top panel, a second end panel, a second bottom panel portion, a first partition, a bridging panel, a second partition and a second flap, comprising the steps of moving said blank along a linear path, first folding said blank and adhesively securing said bridging panel to a mid-portion of said top panel, second folding said blank and adhesively securing said second flap to said first bottom panel portion, and third folding said blank and adhesively securing said first flap to a side of said first partition directly.

2. The method of claim 1 wherein said first folding step comprises folding said blank at a scoreline whereat said second end panel connects to said second bottom panel portion, said second folding step comprises folding said blank at a scoreline whereat said first bottom panel portion connects to said first end panel and adhesively securing a mid-portion of said first bottom panel portion to said second flap and said third folding step comprises folding said blank at each of the four scorelines successively connecting said second end panel to said top panel, said second bottom panel portion to said second end panel, said first partition to said second bottom panel portion and said bridging panel to said first partition.

* * * * *